US012209836B2

(12) United States Patent
Paulson et al.

(10) Patent No.: US 12,209,836 B2
(45) Date of Patent: Jan. 28, 2025

(54) DELINKER WITH CYLINDRICAL PUSHRODS FOR MACHINE GUN

(71) Applicant: DTV Arms, LLC, Hendersonville, TN (US)

(72) Inventors: Kristopher Lee Paulson, Hendersonville, TN (US); Matthew Steinhauser, Philadelphia, PA (US)

(73) Assignee: CHD Holdings, LLC, Nashville, TN (US)

( * ) Notice: Subject to any disclaimer, the term of this patent is extended or adjusted under 35 U.S.C. 154(b) by 0 days.

(21) Appl. No.: 18/370,781

(22) Filed: Sep. 20, 2023

(65) Prior Publication Data

US 2024/0240891 A1 Jul. 18, 2024

Related U.S. Application Data

(60) Provisional application No. 63/439,116, filed on Jan. 14, 2023.

(51) Int. Cl.

| | |
|---|---|
| ***F41A 9/31*** | (2006.01) |
| ***F41A 9/36*** | (2006.01) |
| ***F41A 9/53*** | (2006.01) |

(52) U.S. Cl.

CPC ..... *F41A 9/31* (2013.01); *F41A 9/36* (2013.01); *F41A 9/53* (2013.01)

(58) Field of Classification Search

CPC ..... F41A 9/31; F41A 9/33

See application file for complete search history.

(56) References Cited

U.S. PATENT DOCUMENTS

| | | | | |
|---|---|---|---|---|
| 2019/0137204 | A1* | 5/2019 | Abbott | F41A 9/36 |
| 2019/0257604 | A1* | 8/2019 | Dewalch | F41A 9/31 |
| 2020/0096270 | A1* | 3/2020 | Cleary | F41A 9/31 |

* cited by examiner

*Primary Examiner* — J. Woodrow Eldred

(74) *Attorney, Agent, or Firm* — Mark A. Pitchford; Eric B. Fugett; Pitchford Fugett, PLLC

(57) ABSTRACT

A machine gun (e.g., a minigun) has a delinker including cylindrical or round pushrods inserted in complementary slots in a carrier. The generally cylindrical pushrod and corresponding slots in the carrier require less machining steps than prior rectangular, T shaped or H shaped pushrods and complementary carrier slots making them faster and less expensive to produce and replace. The cylindrical pushrods apply force evenly to heads of ammunition cartridges received in the delinker as they push rounds forward within the delinker such that the rounds are not forced outward from a longitudinal axis of the delinker by the pushrod as the pushrod. A front face of the pushrod has a recess corresponding to a primer of the ammunition cartridge pushed forward by the pushrod within the delinker such that the pushrods do not contact the primer of the ammunition cartridge.

20 Claims, 19 Drawing Sheets

DELINKER WITH CYLINDRICAL PUSHRODS FOR MACHINE GUN

CROSS-REFERENCES TO RELATED APPLICATIONS

This application claims priority to U.S. Provisional Patent Application No. 63/439,116 filed Jan. 14, 2023 entitled "MODULAR DELINKER FOR MACHINE GUN".

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

STATEMENT REGARDING FEDERALLY SPONSORED RESEARCH OR DEVELOPMENT

Not Applicable

REFERENCE TO SEQUENCE LISTING OR COMPUTER PROGRAM LISTING APPENDIX

Not Applicable

BACKGROUND OF THE INVENTION

The present invention relates generally to machine guns (e.g., miniguns such as the M134). More particularly, this invention pertains to delinkers for machine guns utilizing linked ammunition cartridges.

Referring to prior art FIG. 1, a machine gun (e.g., an M134 minigun) 100 used in ground warfare and in helicopter or other aircraft warfare is a six-barrel electrically driven rotary machine gun. The machine gun 100 is conventionally powered by an external battery pack or power supply 105. The power supply (e.g., external battery or vehicle power system) 105 provides power to the minigun drive motor 107, solenoid 109, and booster motor 111. The M134 minigun 100 operates as an "on/off" machine upon activation by pulling the trigger or pressing a button switch 113. That is, the gun 100 operates at a fixed rate of fire. The gun may 100 be selectable between two fixed fire rates via a switch. That is, the gun 100 may have a high setting of 4000 rounds per minute and a low setting of 2000 rounds per minute, and the setting is selectable via a 2 position switch.

The conventional prior art machine gun 100 relies on an external battery pack 105 or power supply having electrical cables supplying power to the drive motor 107, to the solenoid 109 that activates the clutch 125, and to the booster motor 111. When the push button 113 is engaged, power is provided to the drive motor 107, the solenoid 109, and the booster motor 111 from the external power system 105. The drive motor 107 initiates the turning of the rotating barrel assembly 103. The solenoid 109 activates to mate the clutch gear to the feeder delinker assembly 121 (i.e. to the drive gear in the feeder delinker 121). The booster motor 111 begins advancing linked ammunition (e.g., a "chain" of ammunition) into the feeder delinker assembly 121 from an ammunition canister 106 via a sleeve 112. Powering all relevant parts of the gun 100 upon activation of the button 113 initiates the firing action of the gun 100. The delinker 121 provides de-linked ammunition to the barrel assembly 103 which fires each ammunition cartridge and discards spent ammunition casings. The barrel assembly 103 includes a plurality of rotating barrels, an action, and a housing configured to support the rotating components and optionally other components such as the delinker 121, main drive motor 107, gun control unit 113, and delinker clutch solenoid 109. The conventional minigun 100 operates on a fixed rate of fire operated by an on/off push button 113 or switch.

A conventional minigun 100 has a power cable that connects to the motor control unit (also known as a gun control unit), with two shorter cables connecting to the motor control or gun control unit to the motor 107 and the clutch solenoid 109. The booster motor 111 is also powered by the main power cable. The clutch solenoid 109 engages a clutch to drive the delinker from the main drive motor 107 when the gun is firing.

The delinker 121 includes a cast single piece housing. A paddle wheel of the delinker 121 is a single piece designed for a single ammunition cartridge type. Tools are required to disassemble the delinker 121 to clear jams or repair the delinker. If any component is damaged (such as during a major stoppage), replacement of the entire delinker assembly 121 is generally required, and the gun 100 is inoperable and not repairable until a replacement delinker 121 and tools become available. The gun 100 is thus very difficult to clear of malfunctions and repair in the field, especially under stress (i.e., in a combat situation).

Referring especially to FIGS. 12-15, the delinker 121 has a pushrod assembly including pushrods 771 with generally rectangular profiles or cross sections and a carrier 773 having complementary slots 774. The pushrods 771 include at least one shoulder 772 for retaining the pushrod 771 in the slot 774. A front face of each pushrod 771 is cut away to prevent contact of the pushrod 771 with a primer of an ammunition round or cartridge 733 pushed forward by the pushrod 771. Contacting the ammunition cartridge 733 at only a radially inward edge of the ammunition cartridge 733 will push the ammunition round 733 away from the longitudinal axis of the delinker 121 which occasionally causes jamming and/or parts breakage in the delinker 121, disabling the gun 100.

BRIEF SUMMARY OF THE INVENTION

Aspects of the present invention provide a machine gun (e.g., a minigun) with a delinker including cylindrical or round pushrods inserted in complementary slots in a carrier. The generally cylindrical pushrod and corresponding slots in the carrier require less machining steps than prior rectangular, T shaped or H shaped pushrods and complementary carrier slots making them faster and less expensive to produce and replace. The cylindrical pushrods apply force evenly to heads of ammunition cartridges received in the delinker as they push rounds forward within the delinker such that the rounds are not forced outward from a longitudinal axis of the delinker by the pushrod as the pushrod. A front face of the pushrod has a recess corresponding to a primer of the ammunition cartridge pushed forward by the pushrod within the delinker such that the pushrods do not contact the primer of the ammunition cartridge.

In another aspect, a delinker assembly for a machine gun includes a plurality of pushrods and a carrier. The plurality of pushrods is configured to extend generally parallel to a longitudinal axis of the delinker when the delinker is assembled. The pushrods are repeatedly moved forward and rearward by a camming section of the delinker as the delinker operates to push ammunition cartridges forward within the delinker. The carrier is configured to extend along the longitudinal axis of the delinker when the delinker is assembled. The carrier is configured to receive the plurality of pushrods, rotate about the longitudinal axis, and limit movement of each pushrod of the plurality of pushrods to generally parallel to the longitudinal axis as the delinker operates. Each pushrod of the plurality of pushrods has a generally circular cross-section relative to the longitudinal axis.

In another aspect, a machine gun includes a barrel assembly, a delinker, a main drive motor, and a gun control unit. The barrel assembly is configured to receive ammunition cartridges, by the ammunition cartridges and eject the spent casings from the ammunition cartridges. The main drive motor is configured to drive the barrel assembly and the delinker when the gun is assembled in firing. The gun control unit is configured to provide power to the main drive motor when the gun is assembled in firing. The delinker includes a plurality of pushrods and a carrier. The plurality of pushrods is configured to extend generally parallel to a longitudinal axis of the delinker when the delinker is assembled. The pushrods are repeatedly moved forward and rearward by a camming section of the delinker as the delinker operates to push ammunition cartridges forward within the delinker are. The carrier is configured to extend along the longitudinal axis of the delinker when the delinker is assembled. The carrier is configured to receive the plurality of pushrods, rotate about the longitudinal axis, and limit movement of each pushrod of the plurality of pushrods to generally parallel to the longitudinal axis as the delinker operates. Each pushrod of the plurality of pushrods has a generally cylindrical main portion.

BRIEF DESCRIPTION OF THE SEVERAL VIEWS OF THE DRAWINGS

Reference will now be made in detail to optional embodiments of the invention, examples of which are illustrated in accompanying drawings. Whenever possible, the same reference numbers are used in the drawing and in the description referring to the same or like parts.

DETAILED DESCRIPTION OF THE INVENTION

While the making and using of various embodiments of the present invention are discussed in detail below, it should be appreciated that the present invention provides many applicable inventive concepts that can be embodied in a wide variety of specific contexts. The specific embodiments discussed herein are merely illustrative of specific ways to make and use the invention and do not delimit the scope of the invention.

To facilitate the understanding of the embodiments described herein, a number of terms are defined below. The terms defined herein have meanings as commonly understood by a person of ordinary skill in the areas relevant to the present invention. Terms such as "a," "an," and "the" are not intended to refer to only a singular entity, but rather include the general class of which a specific example may be used for illustration. The terminology herein is used to describe specific embodiments of the invention, but their usage does not delimit the invention, except as set forth in the claims.

As described herein, an upright position is considered to be the position of apparatus components while in proper operation or in a natural resting position as described herein. As used herein an upright position of the electrically driven rotary machine gun 100 is when fully assembled with the barrel assembly 103 (i.e., rotor assembly) ready to fire (or firing) in a generally horizontal orientation. Vertical, horizontal, above, below, side, top, bottom and other orientation terms are described with respect to this upright position during operation unless otherwise specified. The term "when" is used to specify orientation for relative positions of components, not as a temporal limitation of the claims or apparatus described and claimed herein unless otherwise specified. The terms "above", "below", "over", and "under" mean "having an elevation or vertical height greater or lesser than" and are not intended to imply that one object or component is directly over or under another object or component.

The phrase "in one embodiment," as used herein does not necessarily refer to the same embodiment, although it may. Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without operator input or prompting, whether these features, elements and/or states are included or are to be performed in any particular embodiment.

Figure 1:
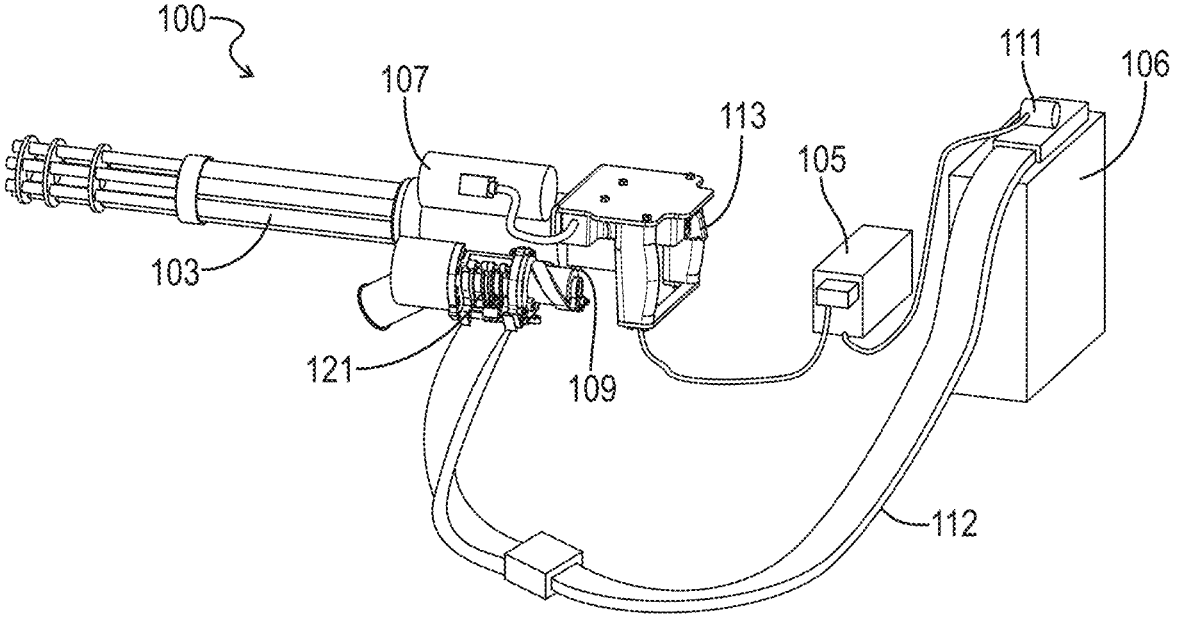
FIG. 1 (PRIOR ART)
FIG. 1 is a prior art machine gun, particularly a M134 minigun.
Figure 2:
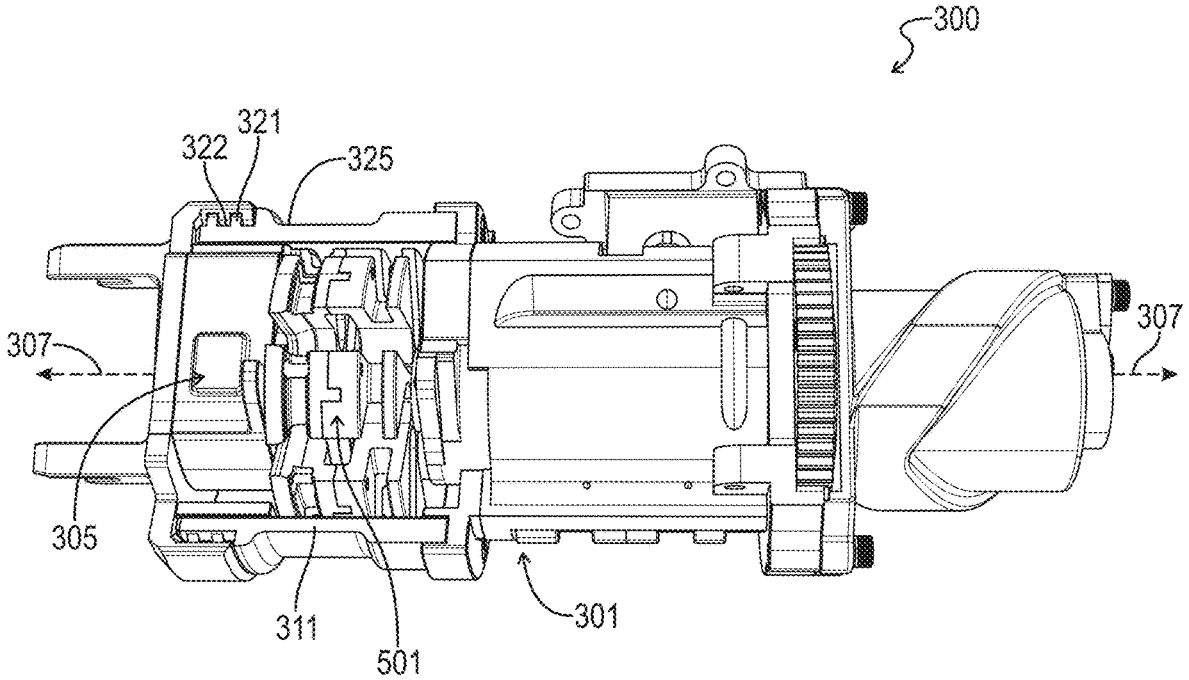
FIG. 2 is a top perspective view of one embodiment of a modular delinker for the machine gun of FIG. 1.
Figure 3:
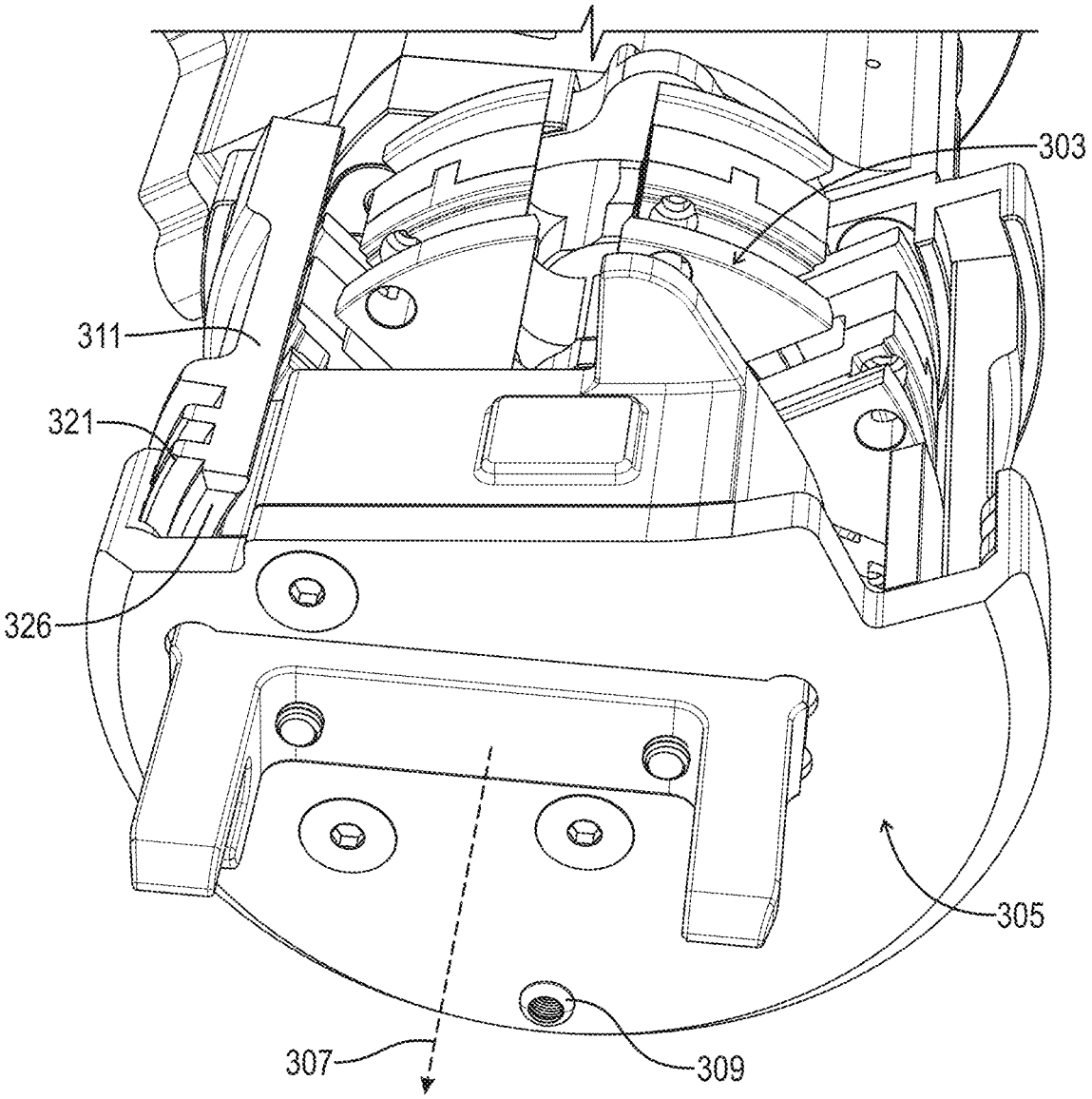
FIG. 3 is an elevated front perspective view of the delinker of FIG. 2.
Figure 4:
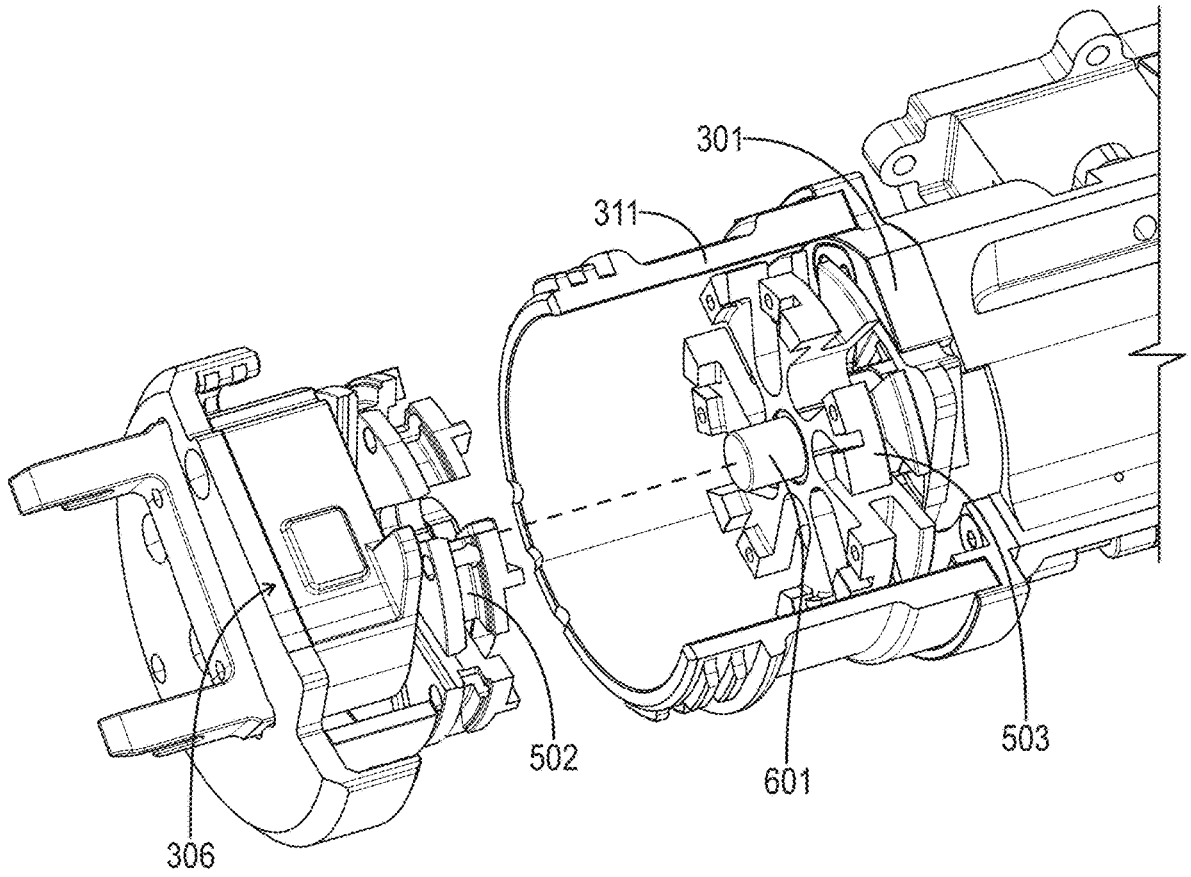
FIG. 4 is a partially exploded top perspective view of the delinker of FIG. 2 showing an alternative second nose and front paddle wheel.
Figure 5:
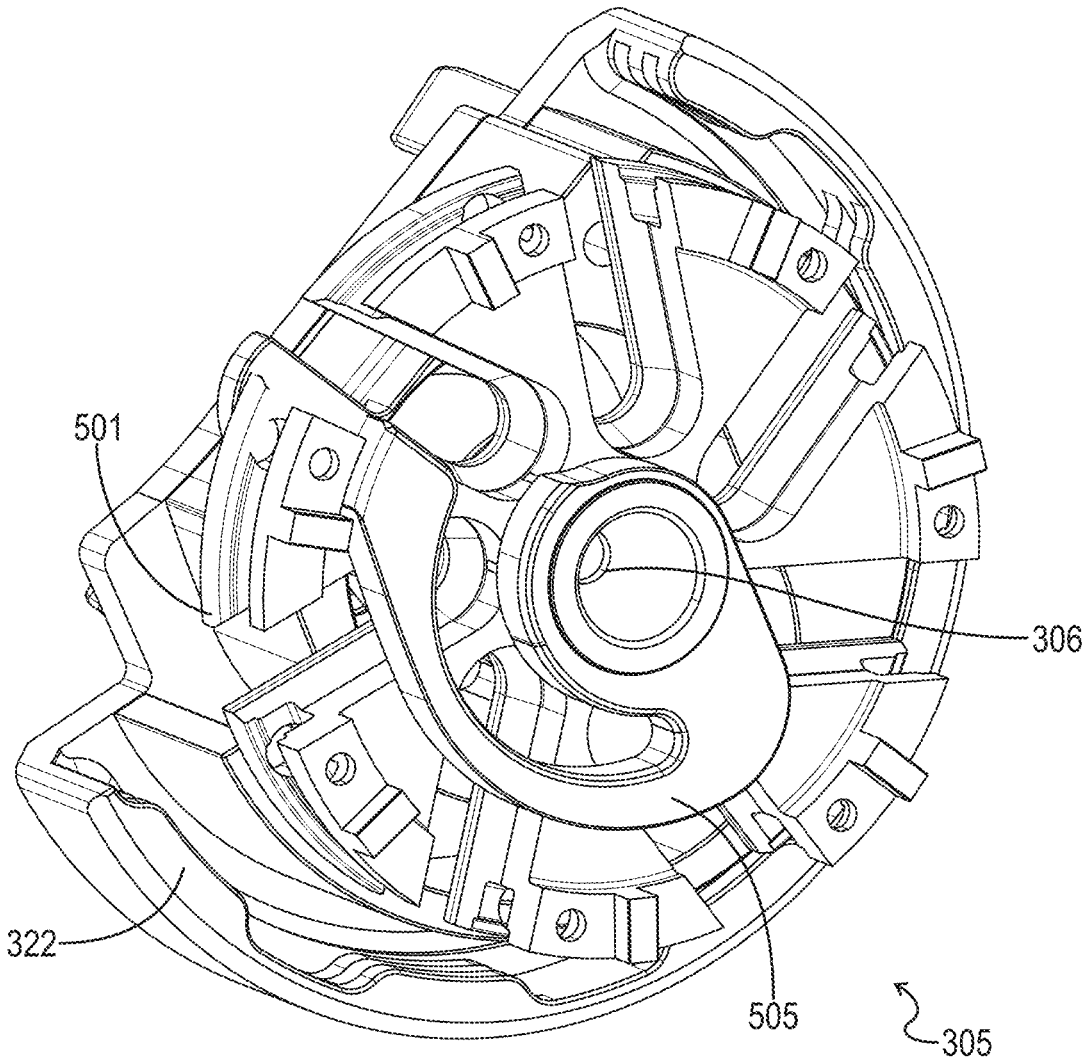
FIG. 5 is a rear perspective view of a nose of the delinker of FIG. 2.
Figure 6:
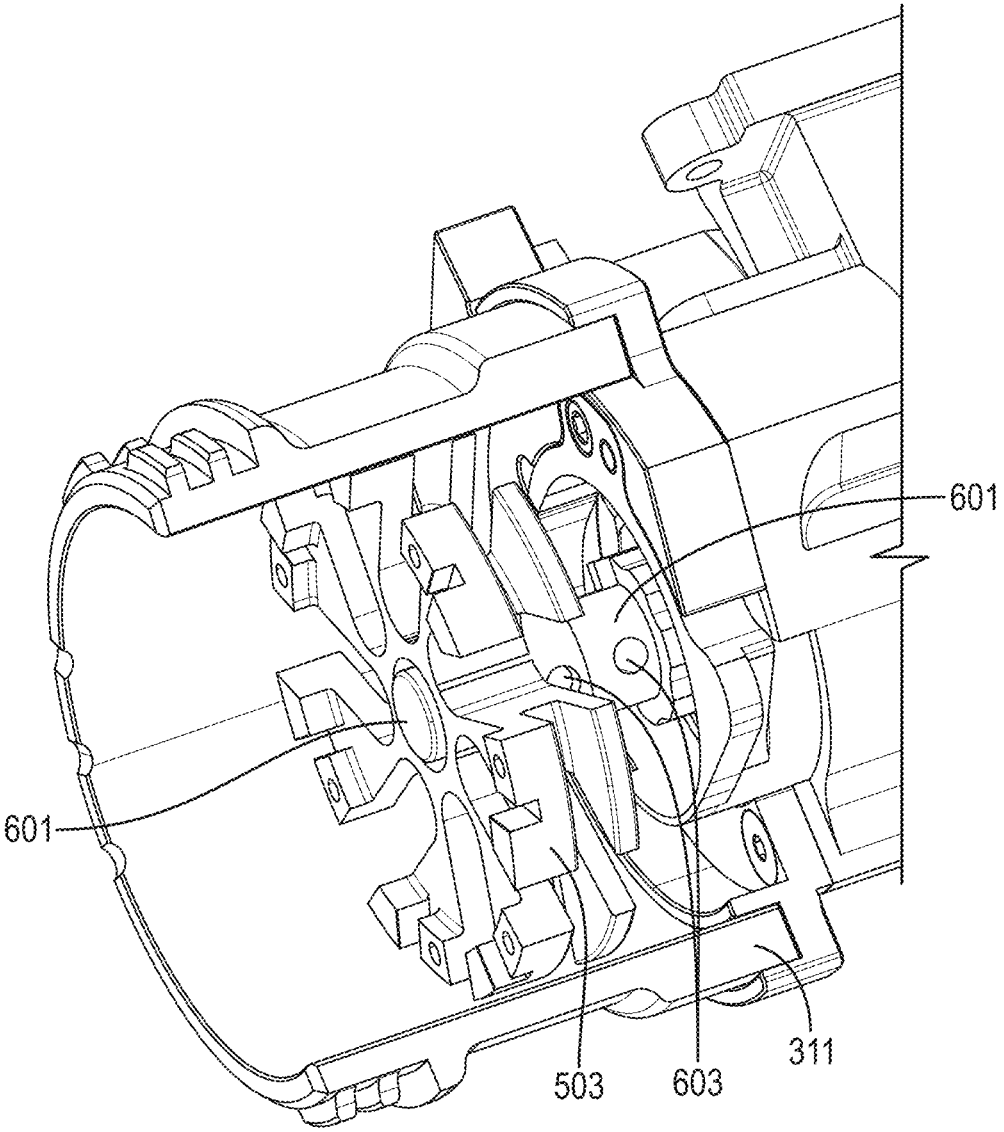
FIG. 6 is a partially exploded top perspective view of the delinker of FIG. 2 with a nose of the delinker removed and a rear paddle wheel moved forward slightly to expose a pin hole through the rear paddle wheel and a driven shaft of the delinker.
Figure 7:
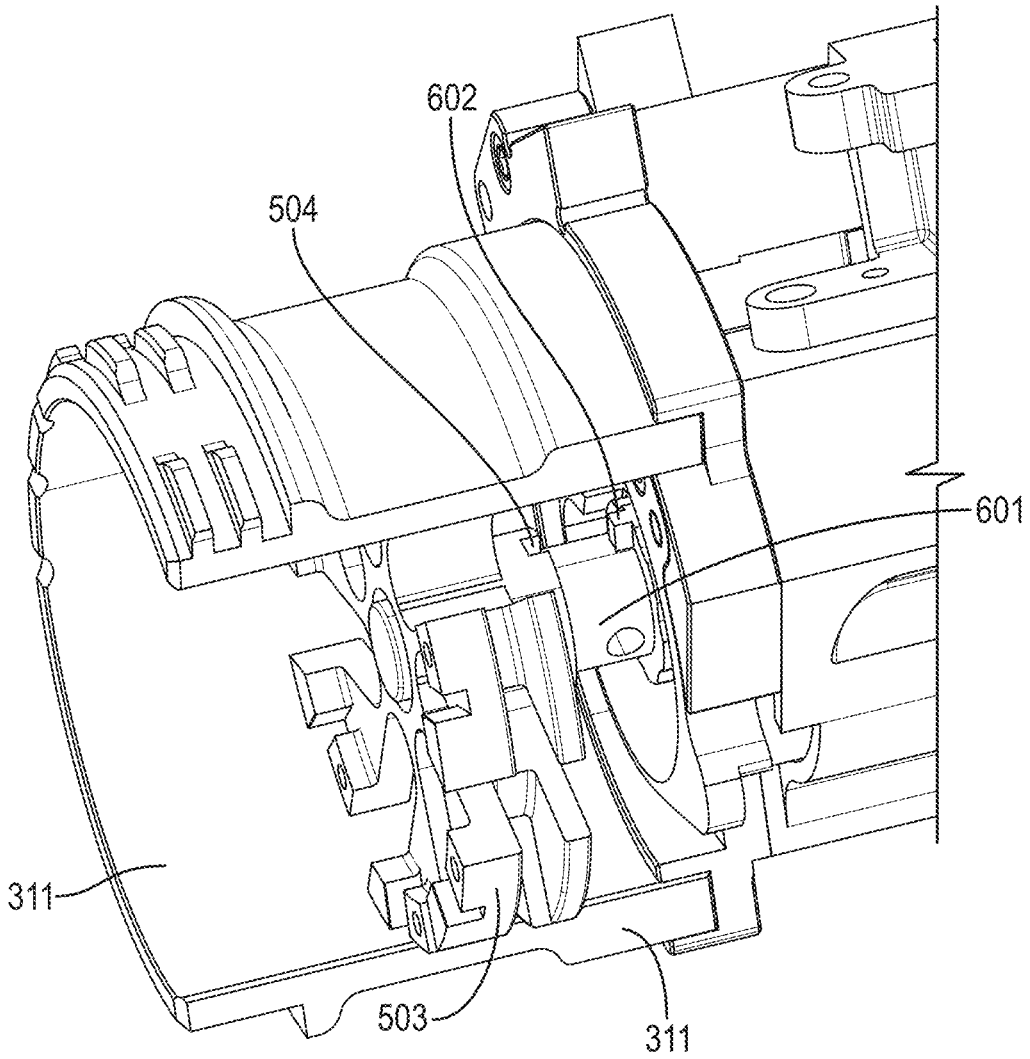
FIG. 7 is a partially exploded top perspective view of the delinker of FIG. 2 with a nose of the delinker removed and a rear paddle wheel moved forward slightly to expose a keyway in the rear paddle wheel and a key on the driven shaft of the delinker.
Figure 8:
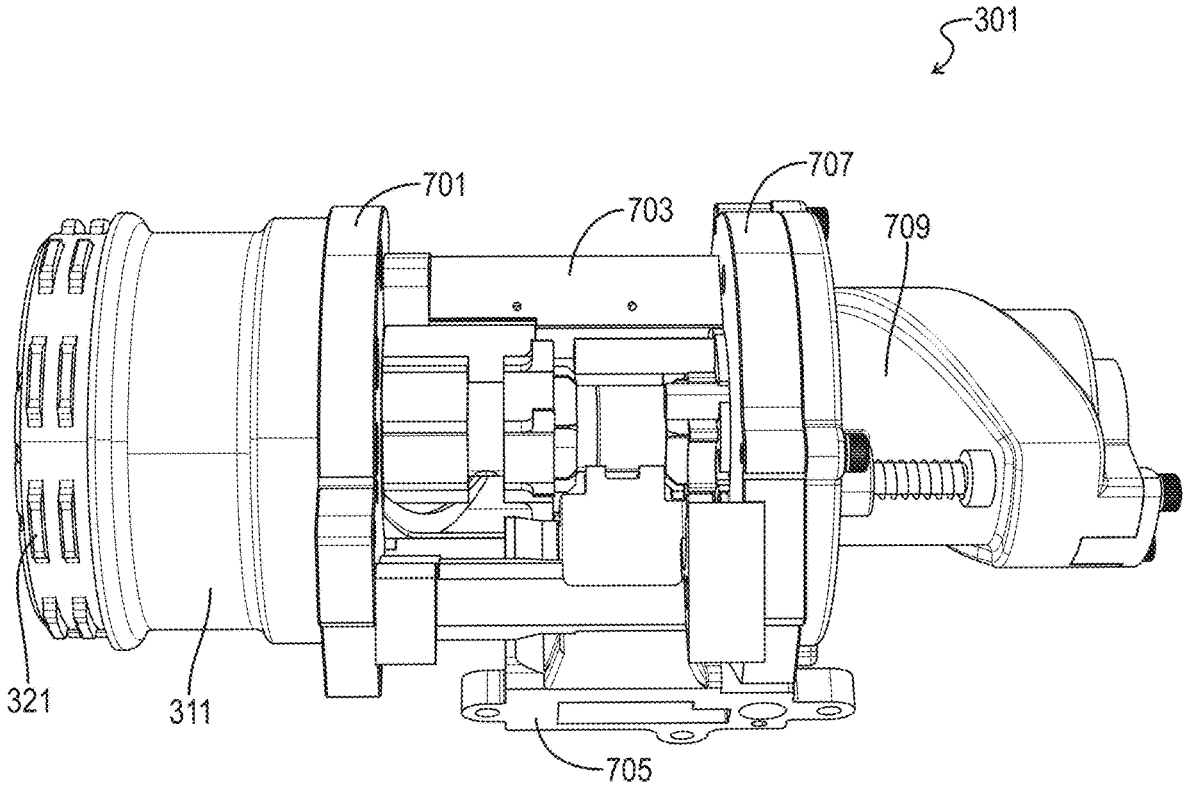
FIG. 8 is a bottom perspective view of the delinker of FIG. 2.
Figure 9:
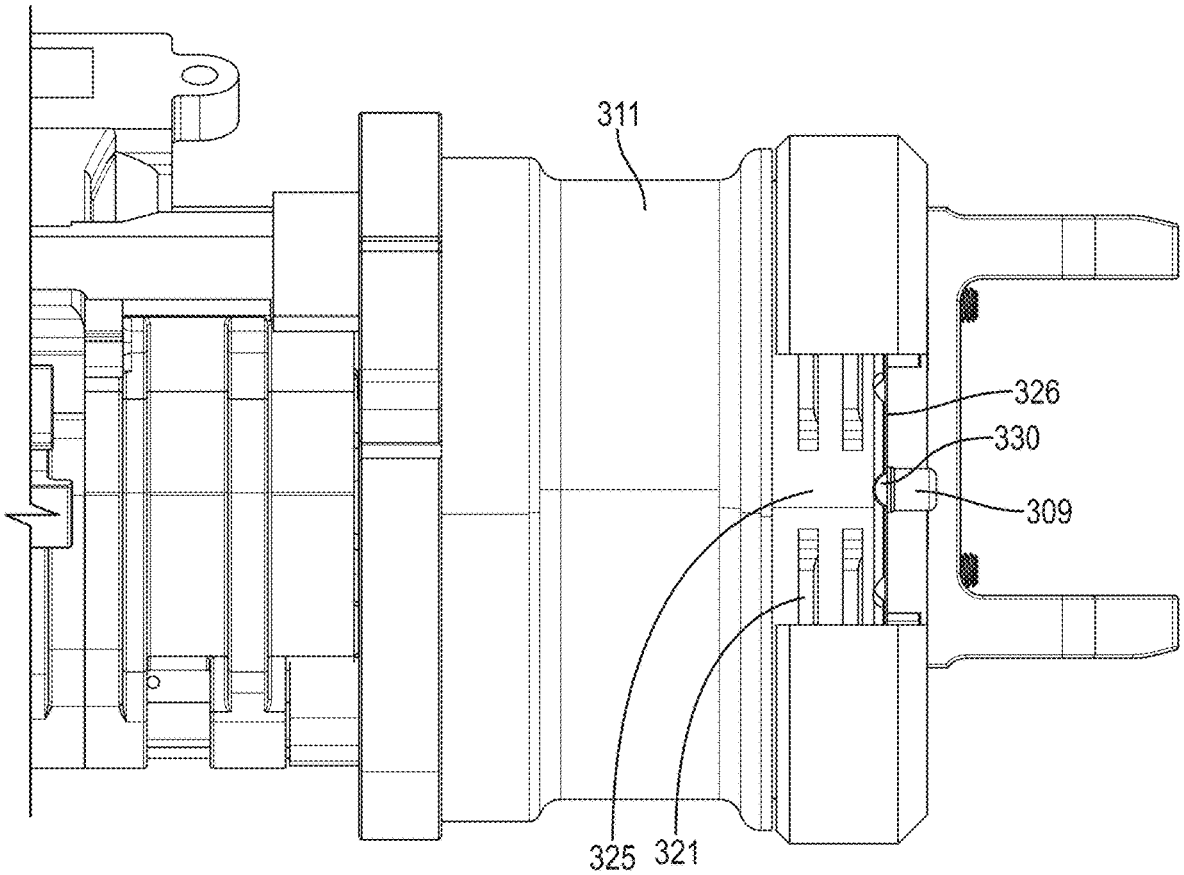
FIG. 9 is a bottom perspective view of the deliner of FIG. 2 with a partial cutaway of the nose to reveal a detent ball and detent clocking the nose to the main body.
Figure 10:
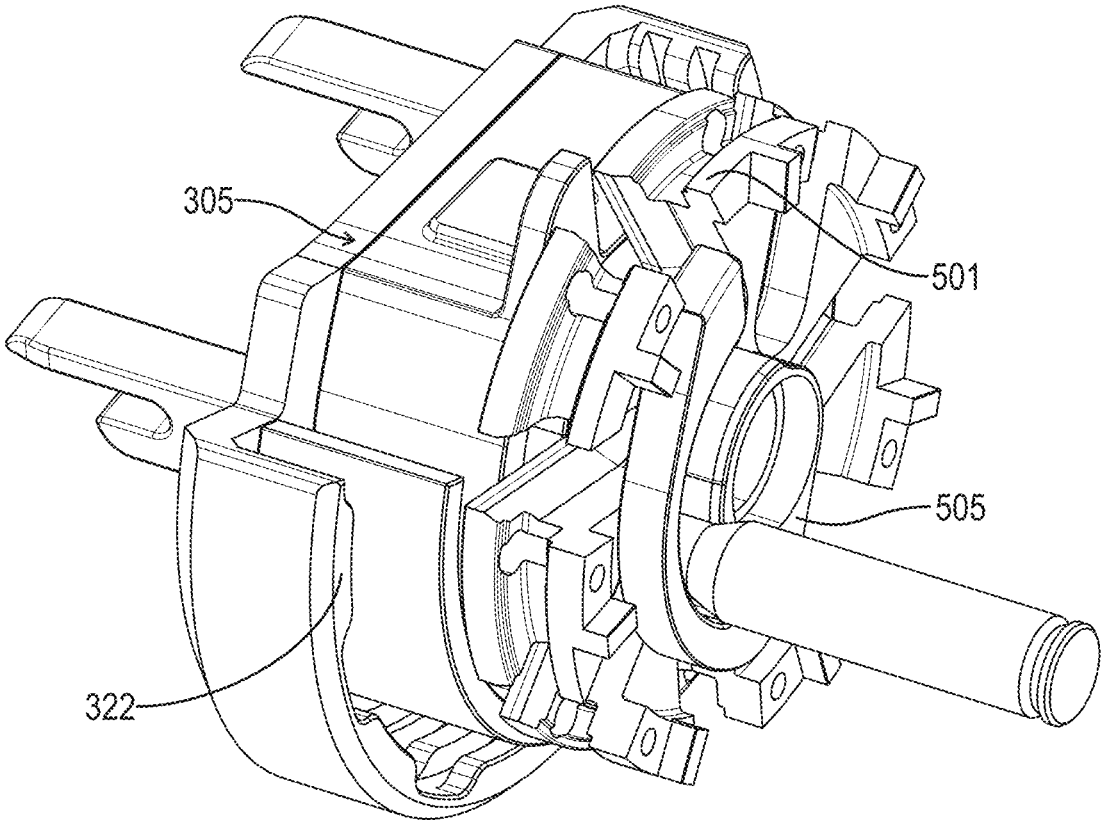
FIG. 10 is a rear isometric view of a nose of the delinker of FIG. 2 showing an ammunition cartridge beginning to engage with an eccentric cam and front paddle wheel of the delinker as the ammunition cartridge moves through the delinker in operation.
Figure 11:
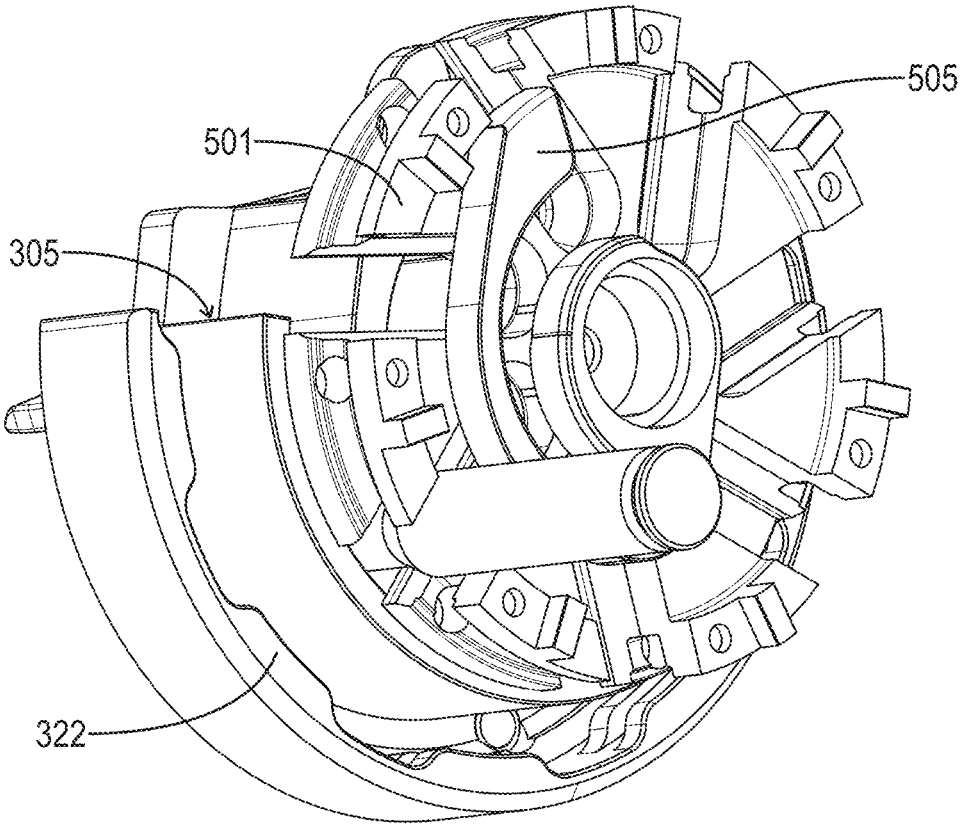
FIG. 11 is a rear isometric view of the nose of FIG. 9 showing the ammunition cartridge engaging with the eccentric cam and the front paddle wheel as the ammunition cartridge is prepared to depart the delinker for the barrel assembly of the machine gun.
Figure 12:
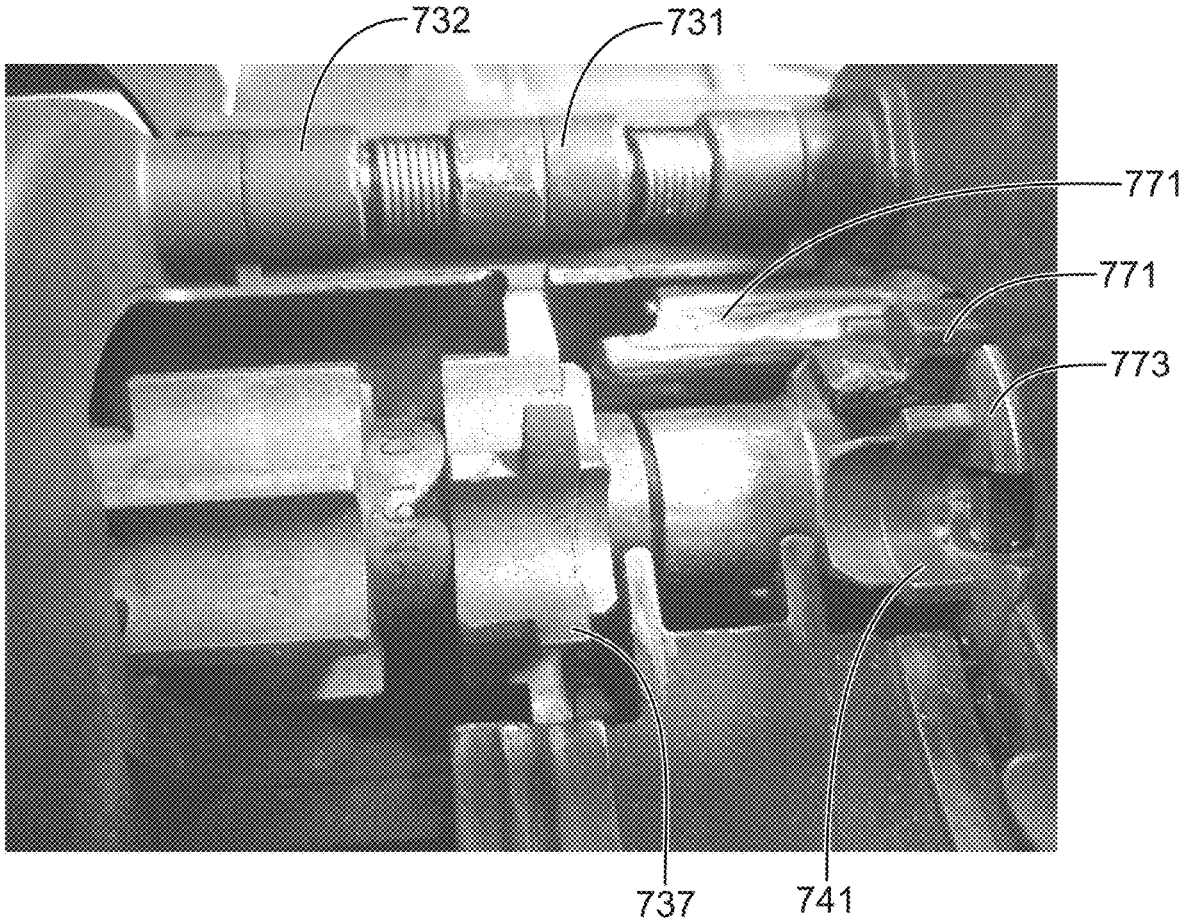
FIG. 12 is a side view of a delinker with PRIOR ART rectangular pushrods therein.
Figure 13:
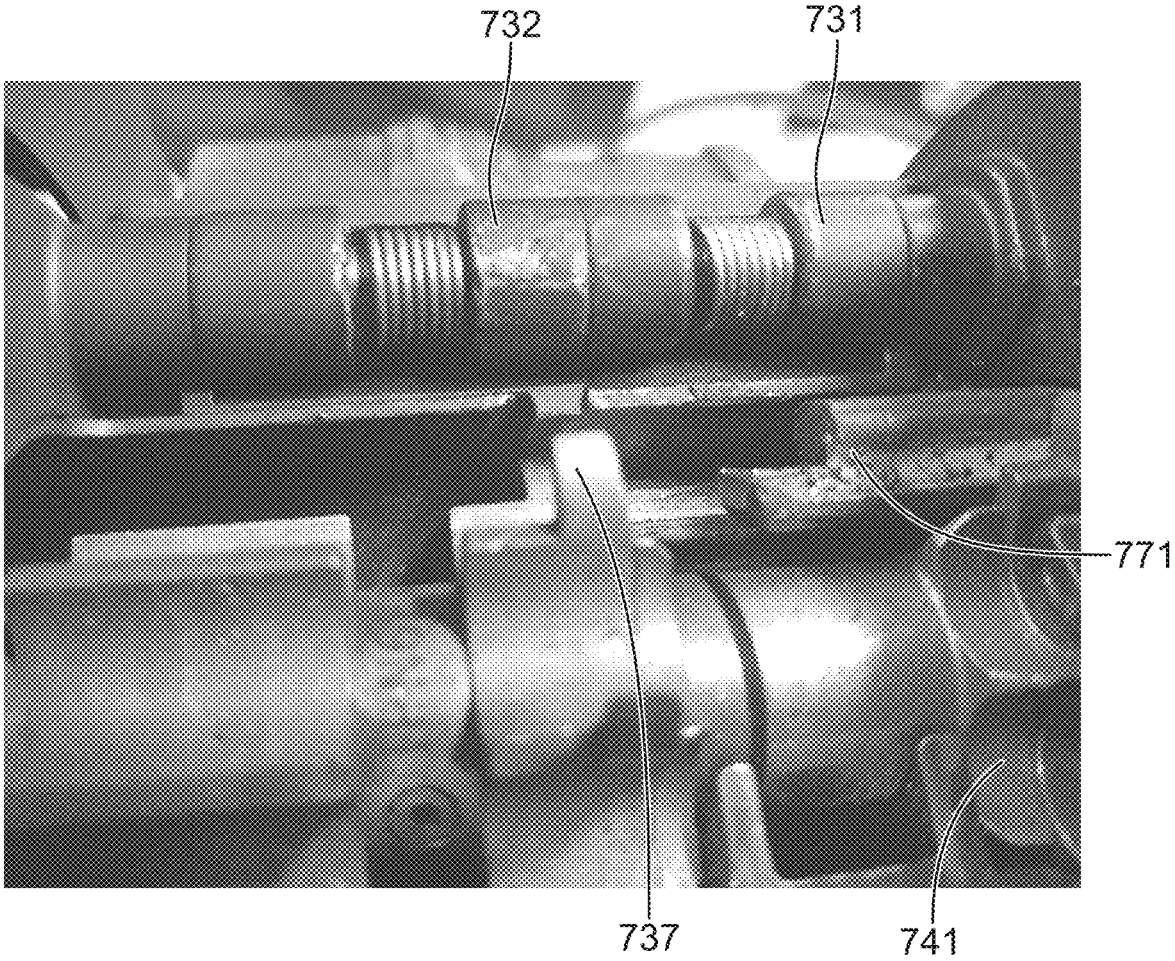
FIG. 13 is a side view of a delinker with a PRIOR ART rectangular pushrod extended to push a round forward in the delinker.
Figure 14:
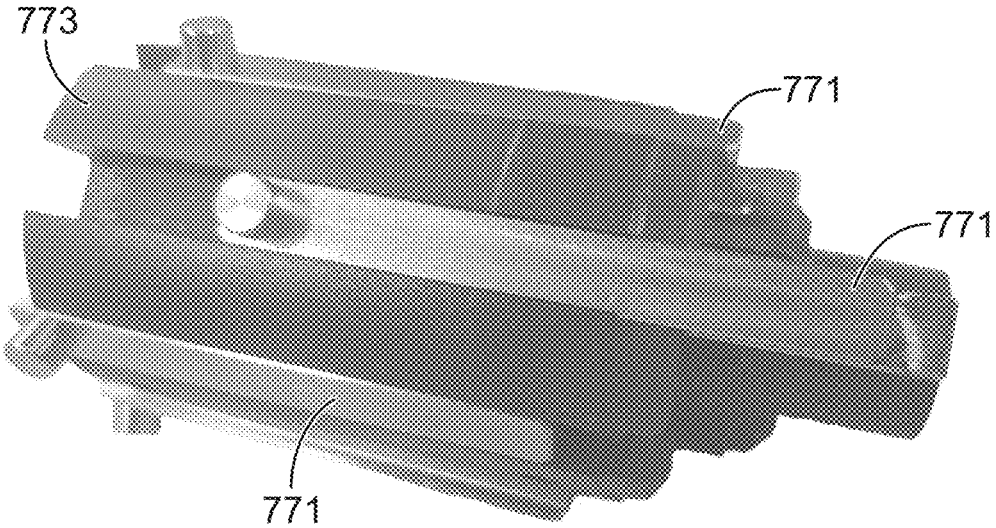
FIG. 14 is an exploded, partial front isometric view of a delinker with PRIOR ART rectangular pushrods.
Figure 15:
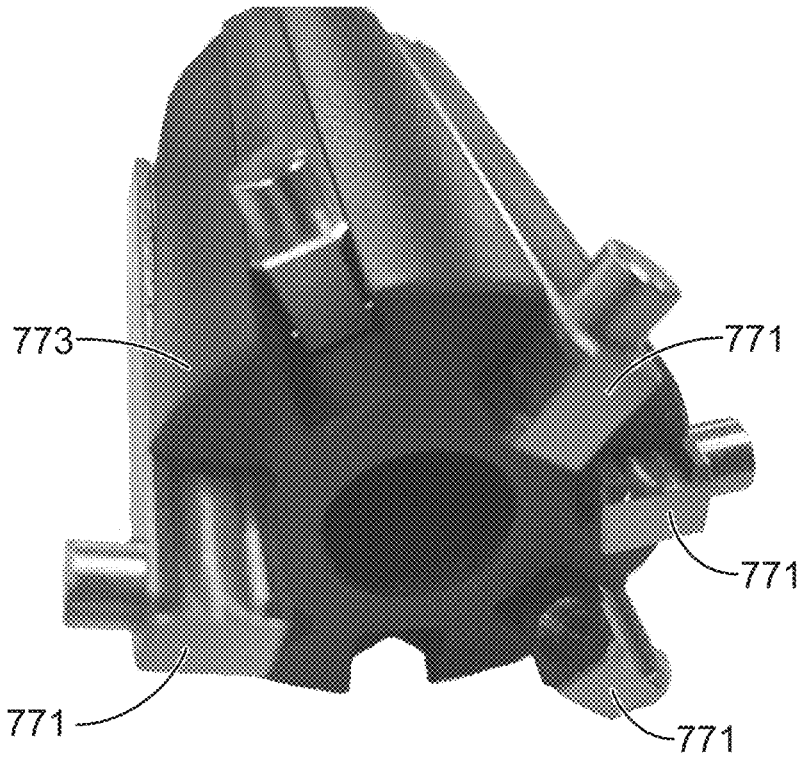
FIG. 15 is an exploded, partial rear isometric view of a delinker with PRIOR ART rectangular pushrods.

Referring now to FIGS. 1-10, according to one embodiment of the invention, a machine gun 100 includes a barrel assembly, a modular delinker 300, a main drive motor 107, and the gun control unit 113. The barrel assembly 103 is configured to receive ammunition cartridges, fire the ammunition cartridges, and a check spent casings from the ammunition cartridges. The main drive motor 107 is configured to drive the barrel assembly 103 in the modular delinker 300 when the gun 100 is assembled in firing. The gun control unit 113 is configured to provide power to the main drive motor 107 when the gun 100 is assembled and firing. In one embodiment, the gun 100 also includes a booster motor 111, a sleeve 112, and a clutch solenoid 109. The booster motor 111 is configured to receive power from the power supply 105 via the gun control unit 113 when the gun 100 is firing. The booster motor 111 sends linked ammunition from the ammunition canister 106 to the delinker 300 when the gun 100 is firing. Sleeve 112 is configured to convey the linked ammunition from the booster motor 111 to the delinker 300 when the gun 100 is assembled in firing. The delinker 300 is driven by the drive motor 107 via the clutch solenoid 109 while the gun 100 is assembled and firing. In one embodiment, the nose 305 extends longitudinally forward of the main body 301 when the delinker 300 is assembled with the nose 305 engaging the main body 301.

In one embodiment, the modular delinker 300 includes a main body 301, a paddlewheel 803, and a nose 305. The main body 301 is configured to receive linked ammunition cartridges in separate and ammunition cartridge from the linked ammunition cartridges when the delinker 300 is operating. The main body 301 extends along a longitudinal axis 307. The forward direction of the longitudinal axis 307 is toward a muzzle of the gun 100 when the delinker 300 is assembled on the gun 100, and a rear direction of the longitudinal axis 307 is opposite the forward direction of the longitudinal axis 307. The paddlewheel 303 is configured to receive the ammunition cartridge from the main body 301 and provide the ammunition cartridge to the barrel assembly 103 of the gun 100 when the delinker 300 is operating. The nose 305 is configured to releasably engage the main body 301 to retain the paddlewheel 303 longitudinally within the main body 301 when the delinker 300 is assembled.

In one embodiment, the main body 301 includes a paddlewheel housing 311 configured to at least partially surround the paddlewheel 303 when the delinker 300 is assembled. The nose 305 releasably engages the paddlewheel housing 311 via a twist lock. In one embodiment, the twist lock is a series of interlocking lugs on the nose 305 and paddlewheel housing 311. In one embodiment, the interlocking lugs include main body lugs 321 spaced about an exterior surface 325 of the paddlewheel housing 311 at a forward end 326 of the paddlewheel housing 311. The interlocking lugs 320 also include nose lugs 322 spaced about an interior surface 327 of the nose 305 at a rear end 328 of the nose 305. In one embodiment, the delinker 300 further includes a spring-loaded detent ball 309 and a detent 330. The detent ball 309 is in the nose 305, and the detent 330 is in the forward end 326 of the paddlewheel housing 311. The detent ball 309 is received in the detent 330 to maintain the nose 305 in a predetermined position with respect to the main body 301 during assembly of the delinker 300 and attachment of the delinker 300 to the barrel assembly 103.

In one embodiment, the paddlewheel 303 includes a front paddlewheel 501 in the rear paddlewheel 503. The nose 305 includes a nose shaft 306 extending along the longitudinal axis 307 when the delinker is assembled. The front paddlewheel 501 is retained on the nose shaft 306 such that when the nose 305 is disengaged from the main body 301 and removed from the paddlewheel housing 311, the front paddlewheel 501 is removed from the main body 301. In one embodiment, the paddlewheel 303 further includes an eccentric cam 505. The eccentric camp of 05 is also retained on the nose shaft 306 rearward of the front paddlewheel 501. The eccentric cam 505 is configured to direct a front of the ammunition cartridge forward and outward from the longitudinal axis 307 of the main body 301 into the front paddlewheel 501 as the ammunition cartridge moves through the delinker 300 to the barrel assembly 103.

In one embodiment, the delinker 300 further includes a driven shaft 601 extending through the rear paddlewheel 503 into the front paddlewheel 501 when the delinker 300 is assembled. The driven shaft 601 rotates the rear paddlewheel 503 when the delinker 300 is assembled and operating (e.g., when the gun 100 is firing). The rear paddlewheel 503 and the driven shaft 601 are configured to interlock with one another when the rear paddlewheel 503 is properly clocked to the driven shaft 601 and the delinker 300 is assembled. In one embodiment, the rear paddlewheel 503 is pinned to the driven shaft 601 such that the rear paddlewheel 503 is retained on the driven shaft 601 when the nose 305 is disengaged and removed from the main body 301. Pin holes 603 through the rear paddlewheel 503 and driven shaft 601 can be seen, for example, in FIG. 6. In one embodiment, the rear paddlewheel 503 and the driven shaft 601 include a complementary key 602 and keyway 504 that interlock with one another when the delinker 300 is assembled. In one embodiment, the front paddlewheel 501 and rear paddlewheel 503 are configured to interlock with one another when the front paddlewheel 501 is properly clocked to the rear paddlewheel 503 such that the rear paddlewheel 503 rotates the front paddlewheel 501 when the delinker 300 is assembled and operating. The front paddlewheel 501 and rear paddlewheel 503 include complementary keys and key ways to interlock with one another when the delinker 300 is assembled.

In one embodiment, the front paddlewheel 501 is a first front paddlewheel 501 having a first ammunition cartridge type (e.g., 7.62×51 mm) and the delinker are 300 includes a second nose 306 including a second front paddlewheel 502 having a second ammunition cartridge type (e.g., 6.8×51 mm). The first ammunition cartridge type is different from the second ammunition cartridge type. The delinker 300 is compatible with the first ammunition type when the first nose 305 is engaging the main body 301 and the delinker 300 is assembled. The delinker 300 is compatible with the second ammunition type when the first nose 305 is disengaged and removed from the main body 301 and the second nose 306 engages the main body 301 and the delinker 300 is thus assembled.

In one embodiment, the main body 301 of the delinker 300 includes a mid plate 701, the paddlewheel housing 311, a round positioner 703, a feed chute adapter 705, a rear plate 707, and a camming section 709. The paddlewheel housing 311 is attached to the mid plate 701 when the delinker 300 is assembled. The round positioner 703 is attached to the mid plate 701 when the delinker 300 assembled. The rear plate 707 is attached to the round positioner 703 when the delinker 300 is assembled. The camming section 709 is attached to the rear plate 707 when the delinker 300 is assembled. The feed chute adapter 705 is attached to the round positioner 703 when the delinker is assembled. Alternatively, the feed chute adapter 705 may be connected to any combination of the mid plate 701, the rear plate 707, and the round positioner 703. In this way, any damaged parts of the delinker 300 main body 301 may be replaced without replacing the entire modular delinker 300, and access to the internal parts of the main body 301 (e.g., the paddle wheel 303, drive gear, cams and palls is possible with simple tools (e.g., a hex key).

Figure 16:
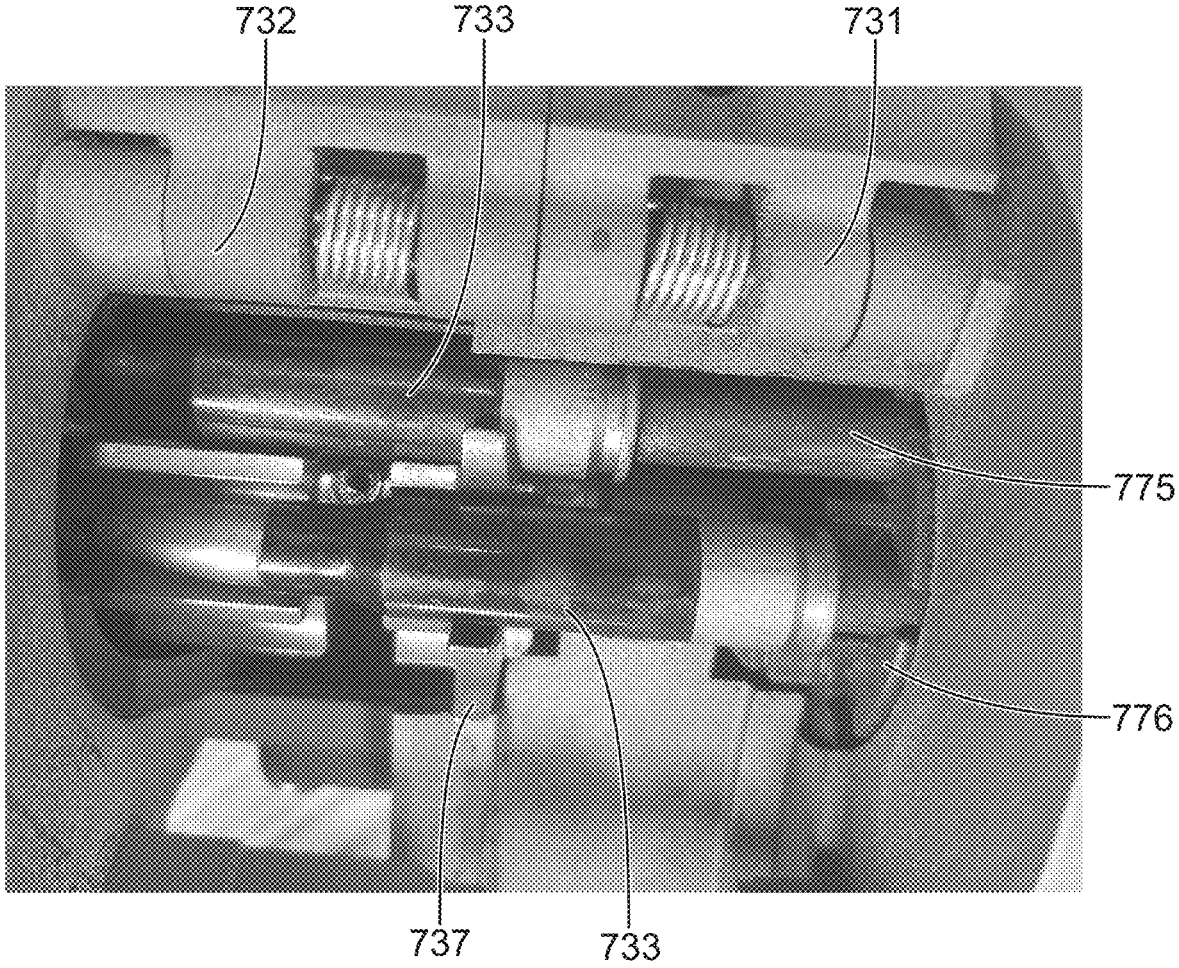
FIG. 16 is a side view of a delinker with cylindrical pushrods.
Figure 17:
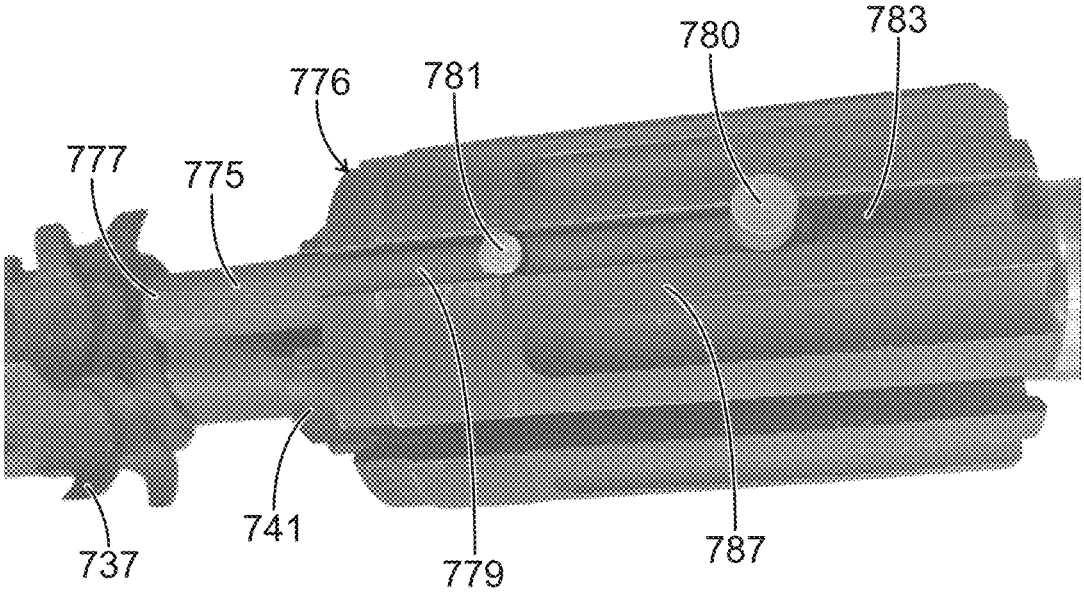
FIG. 17 is an exploded, partial side view of a delinker with cylindrical pushrods.
Figure 18:
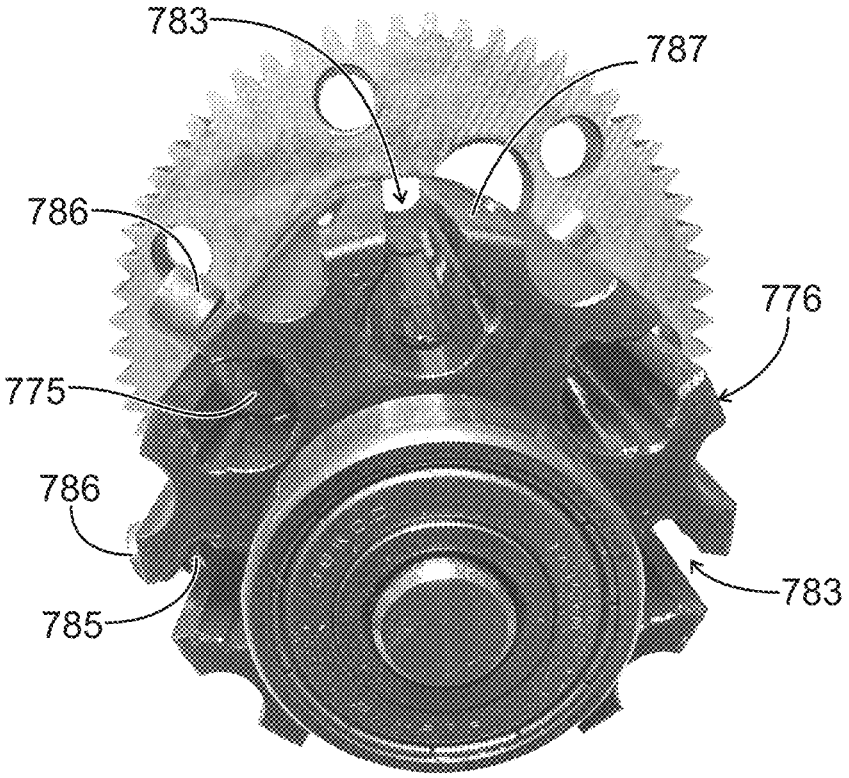
FIG. 18 is an exploded, partial rear isometric view of a delinker with cylindrical pushrods.
Figure 19:
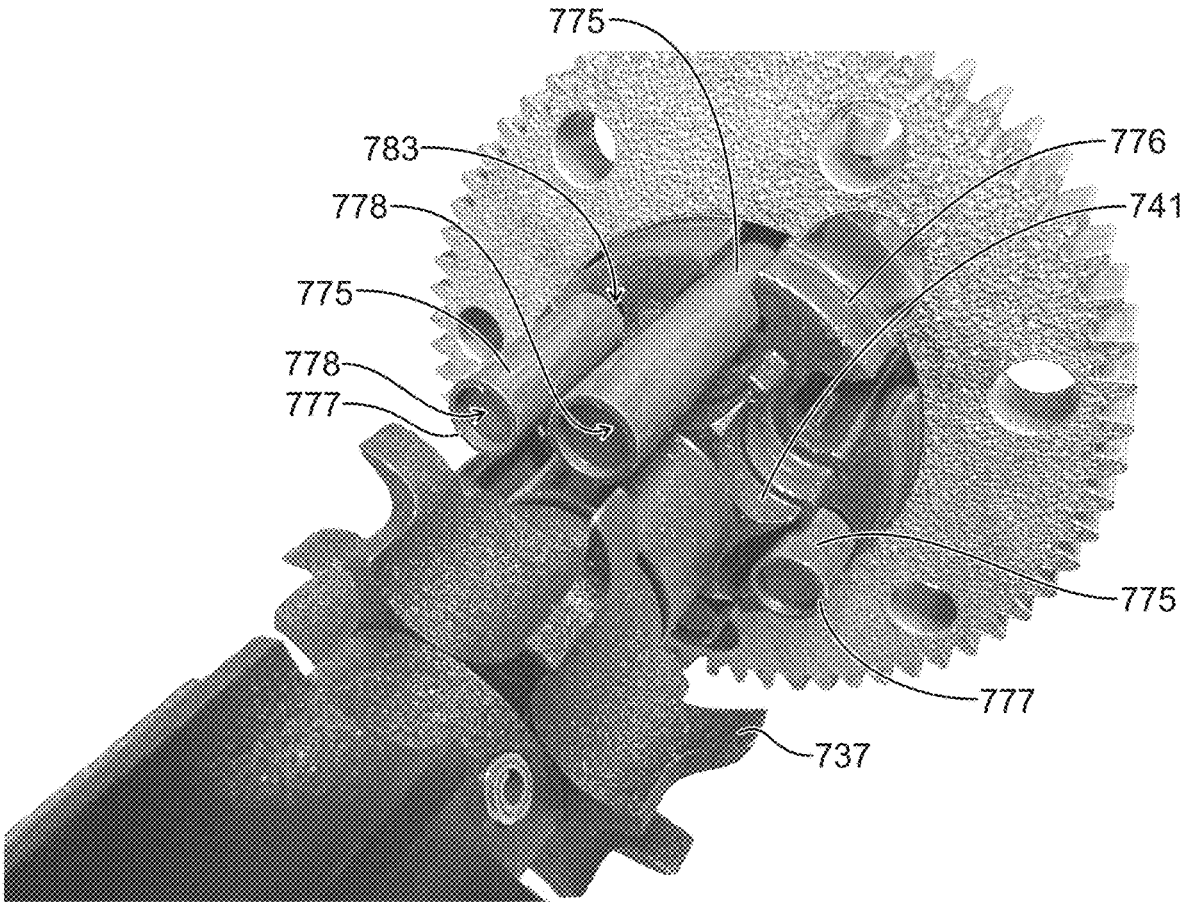
FIG. 19 is a front isometric view of a cylindrical pushrod for a delinker.

Referring especially to FIGS. 16-19, the delinker assembly 300 for the machine gun 100 includes a plurality of pushrods 775 and a carrier 776. Each pushrods 775 of the plurality of pushrods extends generally parallel to the longitudinal axis 307 of the delinker 300 when the delinker 300 is assembled. The pushrods 775 are repeatedly reciprocated forward by the camming section 709 of the delinker 300 as the delinker 300 operates to push ammunition cartridges 733 forward within the delinker 300. In one embodiment, each pushrods 775 of the plurality of pushrods has a generally circular cross-section relative to the longitudinal axis. That is, at most points along the length of the pushrods 775, the cross-section of the pushrods 775 is circular. In particular, a forward face 777 of the pushrods 775 has a circular outline. In one embodiment, an outer diameter of the forward face 777 of the pushrods 775 is greater than a diameter of the primer of each ammunition cartridge 733 and less than an outer diameter of the head of the ammunition cartridge 733. In one embodiment, each pushrods 775 of plurality pushrods includes a recess 778 configured to correspond to the primer of the ammunition cartridge 733 push forward within the delinker 300 by the pushrods 775. In one embodiment, the recess 778 is circular and has a diameter greater than the diameter of the primers of the ammunition cartridges 733. In one embodiment, the recess 778 is generally cylindrical with a longitudinal depth of at least 1 mm. Thus, the recess 778 corresponds to the primers of the ammunition cartridges 733 such that the pushrod 776 does not contact the primers.

In one embodiment, each pushrod 775 includes a main body, a first pin, and, optionally, a second pin. The main body 779 of the pushrods 775 extends parallel to the longitudinal axis 307 when the delinker 300 is assembled. The first pin 780 is configured to extend from the main body 779 radially away from the longitudinal axis 307 when the pushrod 775 is received in the carrier 776 and the delinker 300 is assembled. The second pin 781 is longitudinally spaced from the first pin 780 and extends radially from the main body 779. In one embodiment, the first pin 780 and the second pin 781 cooperate to reciprocate the pushrod 775 within a carrier slot 783 corresponding to the pushrod 775, and maintain alignment of the main body 779 within the slot 783. In one embodiment, the first pin 780 extends radially beyond the carrier 776 away from longitudinal axis 307. In one embodiment, the first pin 780 includes shaft 785 and a cap 786. In one embodiment, the cap 786 extends radially beyond the carrier 776 when the delinker 300 is assembled. The shaft 785 connects the cap 786 to the main body 779 of the pushrod 775. In one embodiment, the cap 786 rotationally (i.e., pivotally) engages the shaft 785 such that the cap 786 is free to rotate about the shaft 785.

The carrier 776 is configured to extend along the longitudinal axis 307 of the delinker 300 when the delinker 300 is assembled. The carrier 776 is configured to receive the plurality of pushrods 775, rotate about the longitudinal axis 307, and limit movement of each push rod 775 of the plurality of pushrods 2 generally parallel to the longitudinal axis 307 as the delinker 300 operates. In one embodiment, the carrier 776 includes a plurality of slots 783 extending therethrough. Each slot 783 of the plurality of slots extends parallel to the longitudinal axis 307. Each slot of the plurality of slots 783 is at a predetermined radial distance from the longitudinal axis 307. The plurality of slots 783 are equally angularly spaced about the longitudinal axis 307 of the carrier 776. That is, the slots 783 are equally spaced about a circumference or radial exterior surface 787 of the carrier 776. In one embodiment, each slot 783 of the plurality of slots is a generally circular cross-section with respect to the longitudinal axis 307 such that the slot 783 is generally complementary to the pushrod 775. In one embodiment, the rounded slot 783 intersects the radial exterior surface 787 of the carrier 776 such that the slot 783 is open through the exterior or radial surface 787 of the carrier 776. In another embodiment, each slot 783 of the plurality of slots has a rectangular extension from the generally circular area of the slot 783 receiving the main body 779 of the pushrod 775 that extends to and through the radially outward surface 787 of the carrier 776. In one embodiment, the rectangular extension is generally complementary to the shaft 785 of the first pin 780 and/or the second pin 781.

This written description uses examples to disclose the invention and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

It will be understood that the particular embodiments described herein are shown by way of illustration and not as limitations of the invention. The principal features of this invention may be employed in various embodiments without departing from the scope of the invention. Those of ordinary skill in the art will recognize numerous equivalents to the specific procedures described herein. Such equivalents are considered to be within the scope of this invention and are covered by the claims.

All of the compositions and/or methods disclosed and claimed herein may be made and/or executed without undue experimentation in light of the present disclosure. While the compositions and methods of this invention have been described in terms of the embodiments included herein, it will be apparent to those of ordinary skill in the art that variations may be applied to the compositions and/or methods and in the steps or in the sequence of steps of the method described herein without departing from the concept, spirit, and scope of the invention. All such similar substitutes and modifications apparent to those skilled in the art are deemed to be within the spirit, scope, and concept of the invention as defined by the appended claims.

Thus, although there have been described particular embodiments of the present invention of a new and useful DELINKER WITH CYLINDRICAL PUSHRODS FOR MACHINE GUN it is not intended that such references be construed as limitations upon the scope of this invention except as set forth in the following claims.

What is claimed is:

1. A delinker for a machine gun comprising:

a plurality of pushrods configured to extend generally parallel to a longitudinal axis of the delinker when the delinker is assembled, wherein the pushrods are repeatedly reciprocated forward by a camming section of the delinker as the delinker operates to push ammunition cartridges forward within the delinker; and a carrier configured to extend along the longitudinal axis of the delinker when the delinker is assembled, said carrier configured to receive the plurality of pushrods, rotate about the longitudinal axis, and limit movement of each pushrod of the plurality of pushrods to generally parallel to the longitudinal axis as the delinker operates, wherein:

each pushrod of the plurality of pushrods has a generally circular cross section relative to the longitudinal axis.

2. The delinker of claim 1, wherein:

the pushrod has a forward face;

an outer diameter of the forward face of the pushrod is greater than a diameter of the primers of the ammunition cartridges; and the outer diameter of the forward face of the pushrod is less than an outer diameter of heads of the ammunition cartridges.

3. The delinker of claim 1, wherein:

each pushrod of the plurality of pushrods comprises a recess configured to correspond to primers of the ammunition cartridges pushed forward within the delinker by the pushrod when the delinker is operating.

4. The delinker of claim 1, wherein:

the pushrod has a forward face;

the forward face of the pushrod has a recess therein;

the recess is circular;

the recess has a diameter greater than a diameter of the primers of the ammunition cartridges.

5. The delinker of claim 1, wherein:

the pushrod has a forward face;

an outer diameter of the forward face of the pushrod is greater than a diameter of the primers of the ammunition cartridges;

the outer diameter of the forward face of the pushrod is less than an outer diameter of heads of the ammunition cartridges;

the forward face of the pushrod has a recess therein;

the recess is circular; and the recess has a diameter greater than the diameter of the primers of the ammunition cartridges.

6. The delinker of claim 1, wherein:

each pushrod of the plurality of pushrods comprises a recess configured to correspond to primers of the ammunition cartridges pushed forward within the delinker by the pushrods; and the recess is generally cylindrical with a longitudinal depth of at least 1 mm.

7. The delinker of claim 1, wherein:

each pushrod of the plurality of pushrods comprises a main body and at least one pin;

the main body extends parallel to the longitudinal axis when the delinker is assembled; and the pin is configured to extend from the main body radially away from the longitudinal axis when the pushrod is received in the carrier and the delinker is assembled.

8. The delinker of claim 1, wherein:

each pushrod of the plurality of pushrods comprises a main body, a first pin, and a second pin;

the main body extends parallel to the longitudinal axis when the delinker is assembled;

the first pin is configured to extend from the main body radially away from the longitudinal axis when the pushrod is received in the carrier and the delinker is assembled; and the second pin is longitudinally spaced from the first pin and extends radially from the main body.

9. The delinker of claim 1, wherein:

each pushrod of the plurality of pushrods comprises a main body and at least one pin;

the main body extends parallel to the longitudinal axis when the delinker is assembled;

the pin is configured to extend from the main body radially away from the longitudinal axis when the pushrod is received in the carrier and the delinker is assembled;

the pin extends radially beyond the carrier;

the pin comprises a shaft and a cap;

the cap of the pin extends radially beyond the carrier when the delinker is assembled; and the shaft connects the cap to the main body of the pushrod.

10. The delinker of claim 1, wherein:

each pushrod of the plurality of pushrods comprises a main body and at least one pin;

the main body extends parallel to the longitudinal axis when the delinker is assembled;

the pin is configured to extend from the main body radially away from the longitudinal axis when the pushrod is received in the carrier and the delinker is assembled;

the pin extends radially beyond the carrier;

the pin comprises a shaft and a cap;

the cap of the pin extends radially beyond the carrier when the delinker is assembled;

the shaft connects the cap to the main body of the pushrod; and the cap rotationally engages the shaft of the pushrod.

11. The delinker of claim 1, wherein:

the carrier has a plurality of slots extending therethrough;

each slot of the plurality of slots extends parallel to the longitudinal axis;

each slot of the plurality of slots is at a predetermined radial distance from the longitudinal axis;

the plurality of slots are equally angularly spaced about the longitudinal axis of the carrier;

each slot is configured to receive a pushrod of the plurality of pushrods; and each slot of the plurality of slots has a generally circular cross section with respect to the longitudinal axis.

12. The delinker of claim 1, wherein:

the carrier has a plurality of slots extending therethrough;

each slot of the plurality of slots extends parallel to the longitudinal axis;

each slot of the plurality of slots is at a predetermined radial distance from the longitudinal axis;

the plurality of slots are equally angularly spaced about the longitudinal axis of the carrier;

each slot is configured to receive a pushrod of the plurality of pushrods; and each slot of the plurality of slots has a generally circular cross section with a rectangular extension toward a radially outward surface of the carrier.

13. The delinker of claim 1, wherein:
the carrier has a plurality of slots extending therethrough;
each slot of the plurality of slots extends parallel to the longitudinal axis;
each slot of the plurality of slots is at a predetermined radial distance from the longitudinal axis;
the plurality of slots are equally angularly spaced about the longitudinal axis of the carrier;
each slot is configured to receive a pushrod of the plurality of pushrods; and
each slot of the plurality of slots has a generally circular cross section with respect to the longitudinal axis, wherein the circle of the cross section intersects a radially outward surface of the carrier.

14. A machine gun comprising:
a barrel assembly configured to receive ammunition cartridges, fire the ammunition cartridges, and eject spent casings from the ammunition cartridges;
a delinker comprising:
a main body configured to receive linked ammunition cartridges and separate an ammunition cartridge from the linked ammunition cartridges when the delinker is operating, wherein the main body extends along a longitudinal axis;
a paddle wheel configured to receive the ammunition cartridge from the main body and provide the ammunition cartridge to the barrel assembly of the machine gun when the delinker is operating;
a nose configured to releasably engage the main body to retain the paddle wheel longitudinally within the main body when the delinker is assembled;
a plurality of pushrods configured to extend generally parallel to a longitudinal axis of the delinker when the delinker is assembled, wherein the pushrods are repeatedly reciprocated forward by a camming section of the delinker as the delinker operates to push ammunition cartridges forward within the delinker; and
a carrier configured to extend along the longitudinal axis of the delinker when the delinker is assembled, said carrier configured to receive the plurality of pushrods, rotate about the longitudinal axis, and limit movement of each pushrod of the plurality of pushrods to generally parallel to the longitudinal axis as the delinker operates, wherein each pushrod of the plurality of pushrods has a generally circular cross section relative to the longitudinal axis;
a main drive motor configured to drive the barrel assembly and the delinker when the gun is assembled and firing; and
a gun control unit configured to provide power to the main drive motor when the gun is assembled and firing.

15. The machine gun of claim 14 further comprising:
a booster motor configured to receive power from a power supply via the gun control unit when the gun is firing, wherein the booster motor sends the linked ammunition from the ammunition canister to the delinker when the gun is firing;
a sleeve configured to convey the linked ammunition from the booster motor to the delinker when the gun is assembled and firing; and
a clutch solenoid, wherein the delinker is driven by the drive motor via the clutch solenoid while the gun is assembled and firing.

16. The machine gun of claim 13, wherein:
the pushrod has a forward face;
an outer diameter of the forward face of the pushrod is greater than a diameter of the primers of the ammunition cartridges;
the outer diameter of the forward face of the pushrod is less than an outer diameter of heads of the ammunition cartridges;
the forward face of the pushrod has a recess therein;
the recess is circular; and
the recess has a diameter greater than the diameter of the primers of the ammunition cartridges.

17. The machine gun of claim 13, wherein:
each pushrod of the plurality of pushrods comprises a main body, a first pin, and a second pin;
the main body extends parallel to the longitudinal axis when the delinker is assembled;
the first pin is configured to extend from the main body radially away from the longitudinal axis when the pushrod is received in the carrier and the delinker is assembled; and
the second pin is longitudinally spaced from the first pin and extends radially from the main body.

18. The machine gun of claim 13, wherein:
each pushrod of the plurality of pushrods comprises a main body and at least one pin;
the main body extends parallel to the longitudinal axis when the delinker is assembled;
the pin is configured to extend from the main body radially away from the longitudinal axis when the pushrod is received in the carrier and the delinker is assembled;
the pin extends radially beyond the carrier;
the pin comprises a shaft and a cap;
the cap of the pin extends radially beyond the carrier when the delinker is assembled;
the shaft connects the cap to the main body of the pushrod; and
the cap rotationally engages the shaft of the pushrod.

19. The machine gun of claim 13, wherein:
the carrier has a plurality of slots extending therethrough;
each slot of the plurality of slots extends parallel to the longitudinal axis;
each slot of the plurality of slots is at a predetermined radial distance from the longitudinal axis;
the plurality of slots are equally angularly spaced about the longitudinal axis of the carrier;
each slot is configured to receive a pushrod of the plurality of pushrods; and
each slot of the plurality of slots has a generally circular cross section with a rectangular extension toward a radially outward surface of the carrier.

20. The machine gun of claim 13, wherein:
the carrier has a plurality of slots extending therethrough;
each slot of the plurality of slots extends parallel to the longitudinal axis;
each slot of the plurality of slots is at a predetermined radial distance from the longitudinal axis;
the plurality of slots are equally angularly spaced about the longitudinal axis of the carrier;
each slot is configured to receive a pushrod of the plurality of pushrods; and
each slot of the plurality of slots has a generally circular cross section with respect to the longitudinal axis, wherein the circle of the cross section intersects a radially outward surface of the carrier.

* * * * *